US008011156B1

(12) United States Patent
Schwan

(10) Patent No.: US 8,011,156 B1
(45) Date of Patent: Sep. 6, 2011

(54) CONSTRUCTION SET

(76) Inventor: Paul R. Schwan, Wantagh, NY (US)

( * ) Notice: Subject to any disclaimer, the term of this patent is extended or adjusted under 35 U.S.C. 154(b) by 489 days.

(21) Appl. No.: 12/182,981

(22) Filed: Jul. 30, 2008

Related U.S. Application Data

(60) Provisional application No. 60/962,685, filed on Jul. 31, 2007.

(51) Int. Cl.
*E04H 1/00* (2006.01)

(52) U.S. Cl. ..... 52/653.1; 52/648.1; 52/655.1

(58) Field of Classification Search ..... 52/653.1, 52/648.1, 655.1, 79.5, 79.9, 79.13, 650.1, 52/656.1, 656.9; 446/476
See application file for complete search history.

(56) References Cited

U.S. PATENT DOCUMENTS

| | | | | | |
|---|---|---|---|---|---|
| 1,347,808 | A * | 7/1920 | Franklin | 403/119 |
| 1,898,297 | A | 2/1933 | Fox | |
| 2,156,155 | A * | 4/1939 | Howard | 446/113 |
| 2,732,654 | A * | 1/1956 | Sullivan | 446/127 |
| 2,943,716 | A * | 7/1960 | Babcock | 52/653.1 |
| 3,168,793 | A * | 2/1965 | Gibson | 446/127 |
| 3,657,838 | A | 4/1972 | Hanning et al. | |
| 4,084,344 | A | 4/1978 | Asano | |
| 5,036,634 | A * | 8/1991 | Lessard et al. | 52/79.1 |
| 5,199,919 | A | 4/1993 | Glickman | |
| 5,239,803 | A | 8/1993 | Shannon | |
| 5,289,665 | A * | 3/1994 | Higgins | 52/655.1 |
| 5,412,913 | A * | 5/1995 | Daniels et al. | 52/79.13 |
| 5,527,201 | A | 6/1996 | Maddock | |
| D379,523 | S | 5/1997 | Azar | |
| 6,138,427 | A * | 10/2000 | Houghton | 52/655.1 |
| 6,802,169 | B2 * | 10/2004 | Simmons | 52/648.1 |
| 7,310,920 | B2 * | 12/2007 | Hovey, Jr. | 52/655.1 |
| 7,762,038 | B2 * | 7/2010 | Ceba et al. | 52/653.1 |
| 2010/0095612 | A1 * | 4/2010 | Antonic | 52/210 |

* cited by examiner

*Primary Examiner* — Brian E Glessner
*Assistant Examiner* — Beth Stephan

(57) ABSTRACT

A construction set for allowing a user to construct a variety of different structures comprising a plurality of Type A beams, a plurality of Type B beams, a plurality of base columns, a plurality of intermediate columns, a plurality of base plates attached to the base columns, and a plurality of deck pieces for laying atop the beams to create a floor.

3 Claims, 7 Drawing Sheets

PEG WOULD BE LOCATED HERE FOR TYBE B BEAMS.

CONSTRUCTION SET

This application claims benefit to U.S. Provisional Patent Application No. 60/962,685, the disclosure of which is incorporated in its entirety by reference herein.

FIELD OF THE INVENTION

The present invention is directed to a toy construction set.

BACKGROUND OF THE INVENTION

The present invention features a construction set for allowing a user to construct a variety of different structures (e.g., buildings). The construction set comprises a plurality of beams and a plurality of columns. The columns are for orienting in a vertical direction and the beams are for orienting in a horizontal direction, wherein the beams may interlock with the columns and/or the columns may interlock with other columns to create a structure of the user's choice. The construction set further comprises a plurality of base plates attached to the columns for stabilizing the columns; and deck pieces for laying atop the beams to create a floor.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
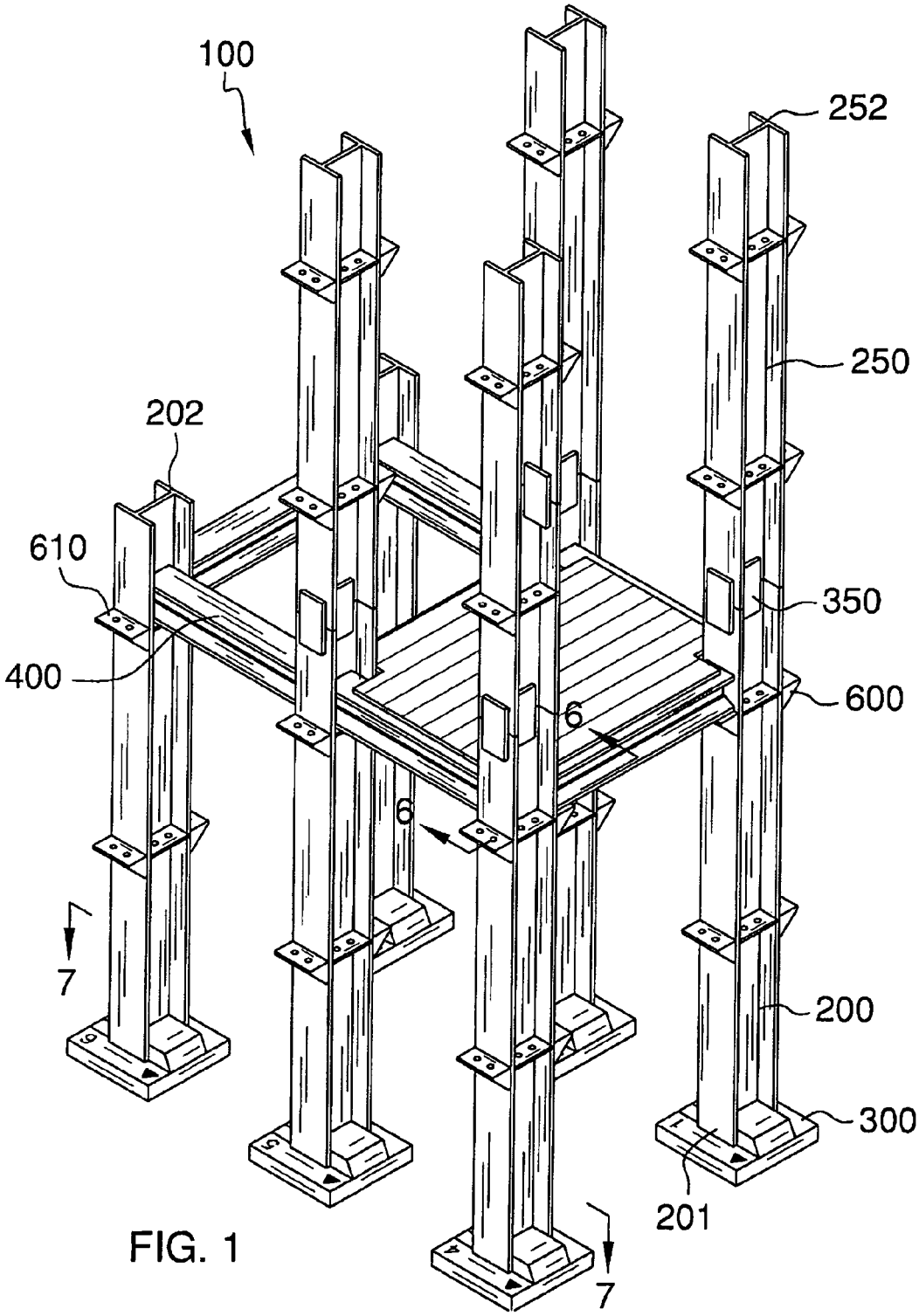
FIG. 1 is a perspective view of the construction set of the present invention.

The following is a listing of numbers corresponding to a particular element refer to herein:

100 construction set
200 base column
201 first end of base column
202 second end of base column
250 intermediate column
251 first end of intermediate column
252 second end of intermediate column
300 base plate
350 splice plate
400 Type A beam
401 first end of Type A beam

Figure 2:
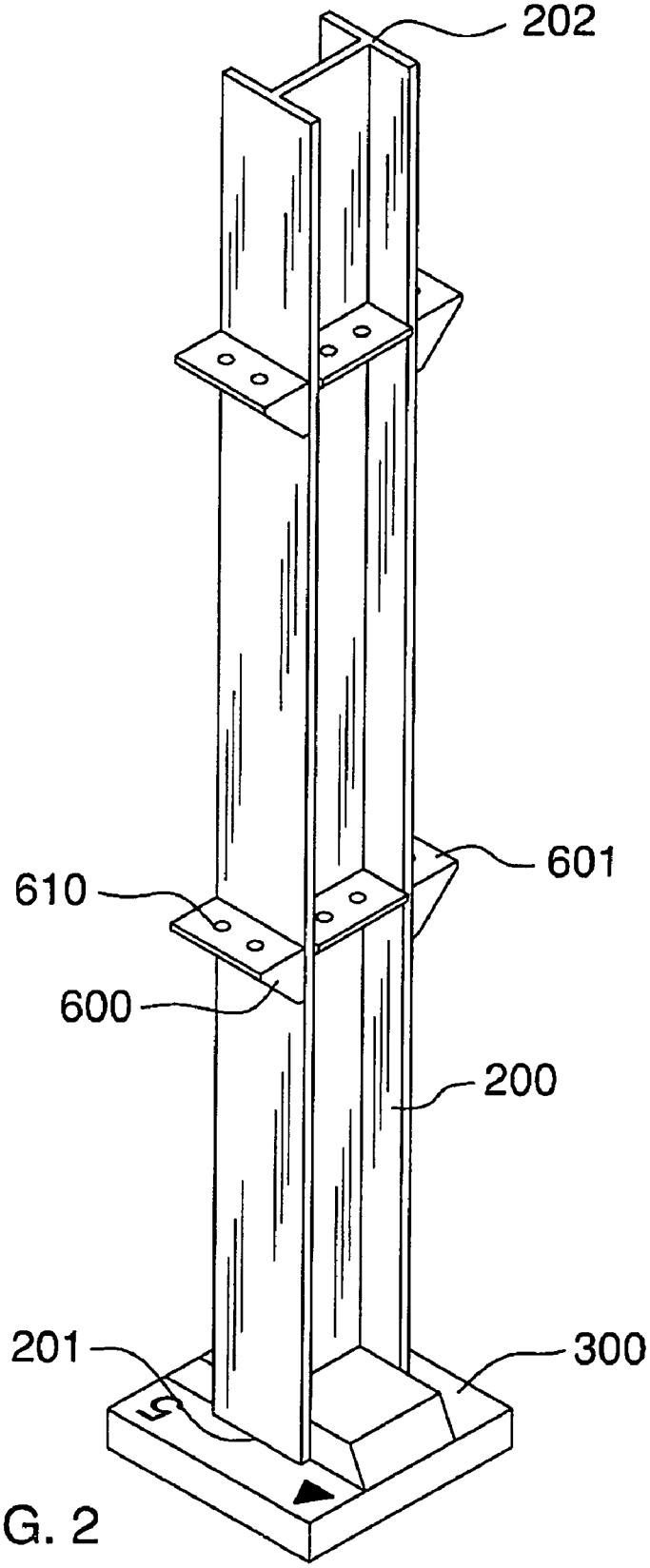
FIG. 2 is a perspective view of a base column of the construction set of the present invention.
Figure 3:
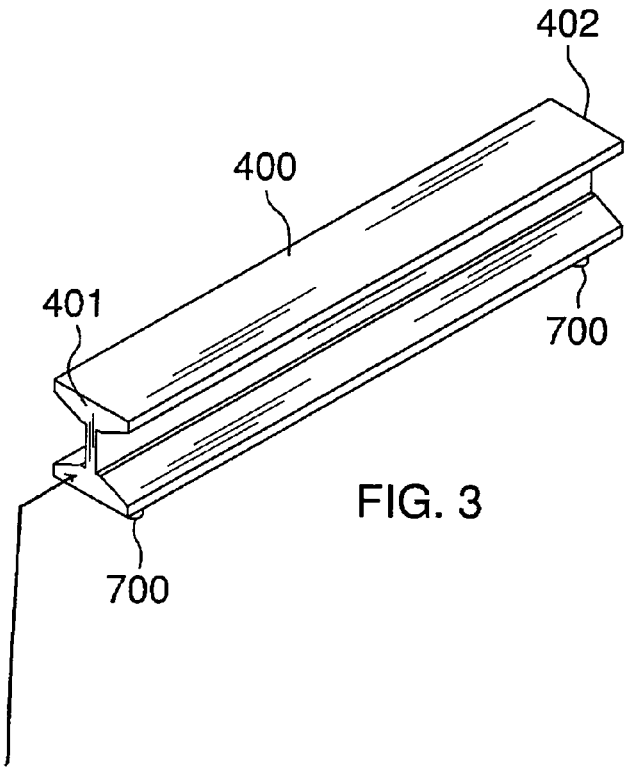
FIG. 3 is a perspective view of a Type A beam of the construction set of the present invention.
Figure 4:
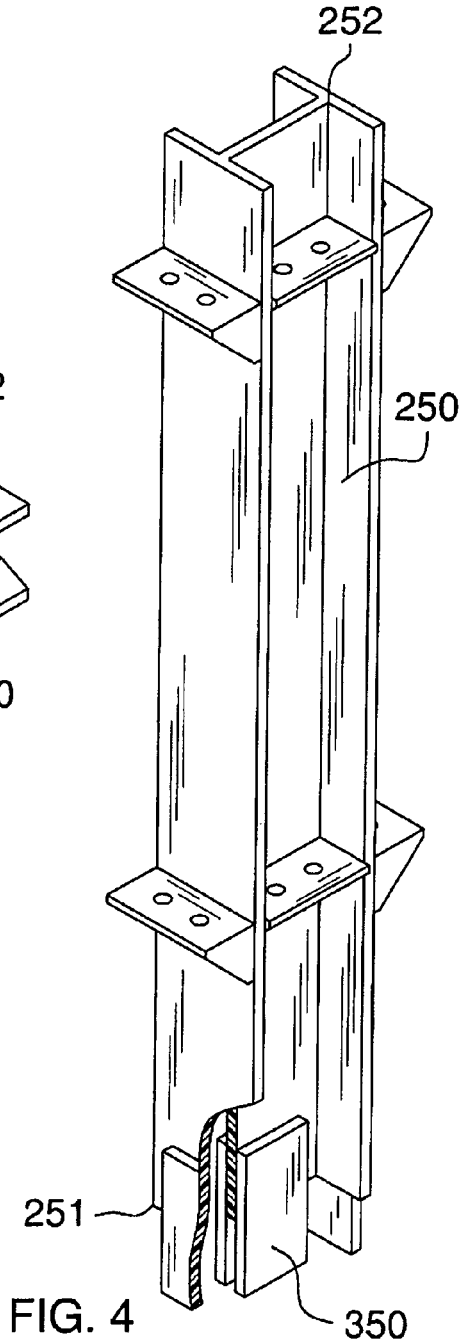
FIG. 4 is a perspective view of an intermediate column of the construction set of the present invention.
Figure 5:
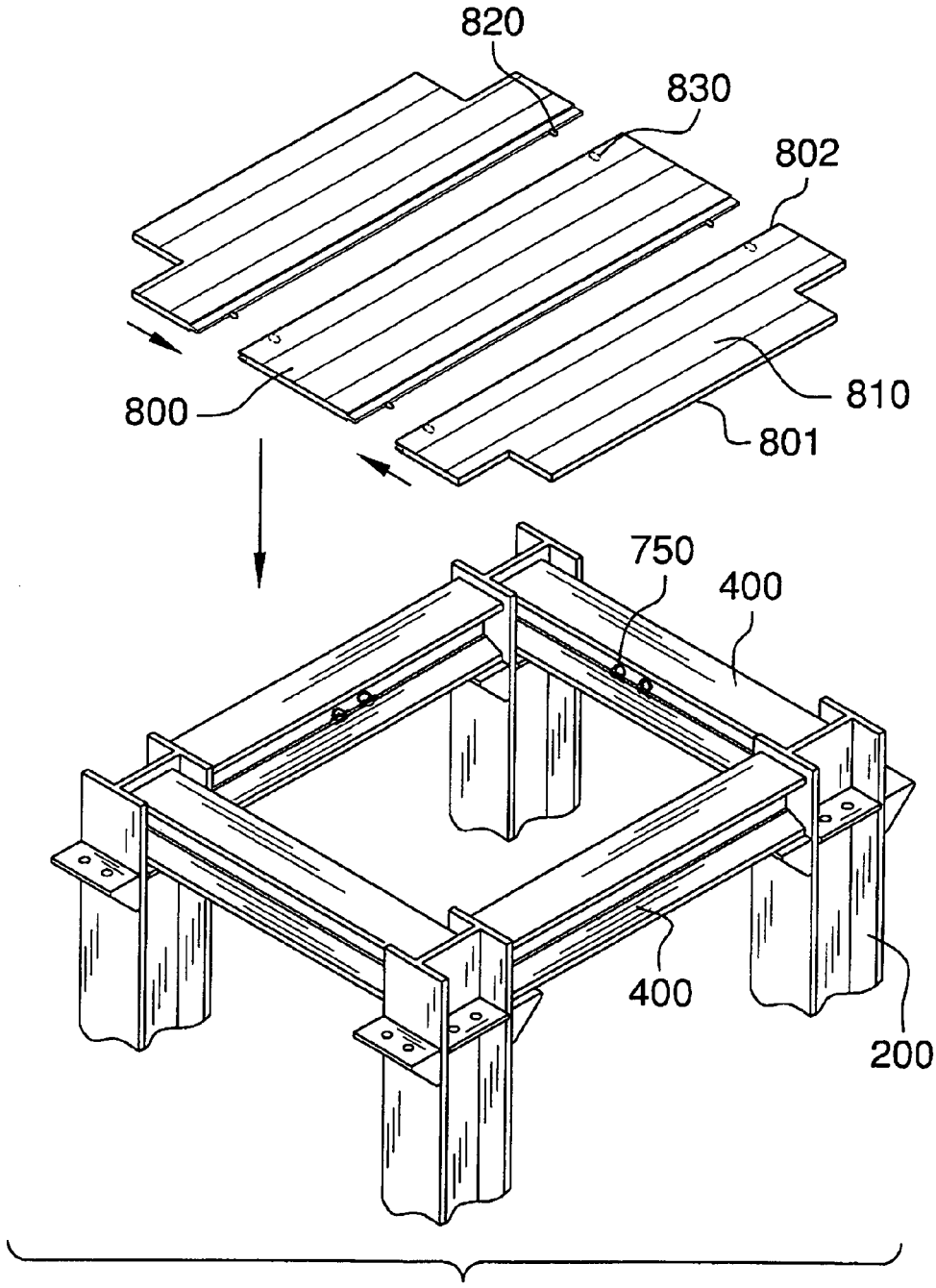
FIG. 5 is a perspective view of the construction set of the present invention.
Figure 6:
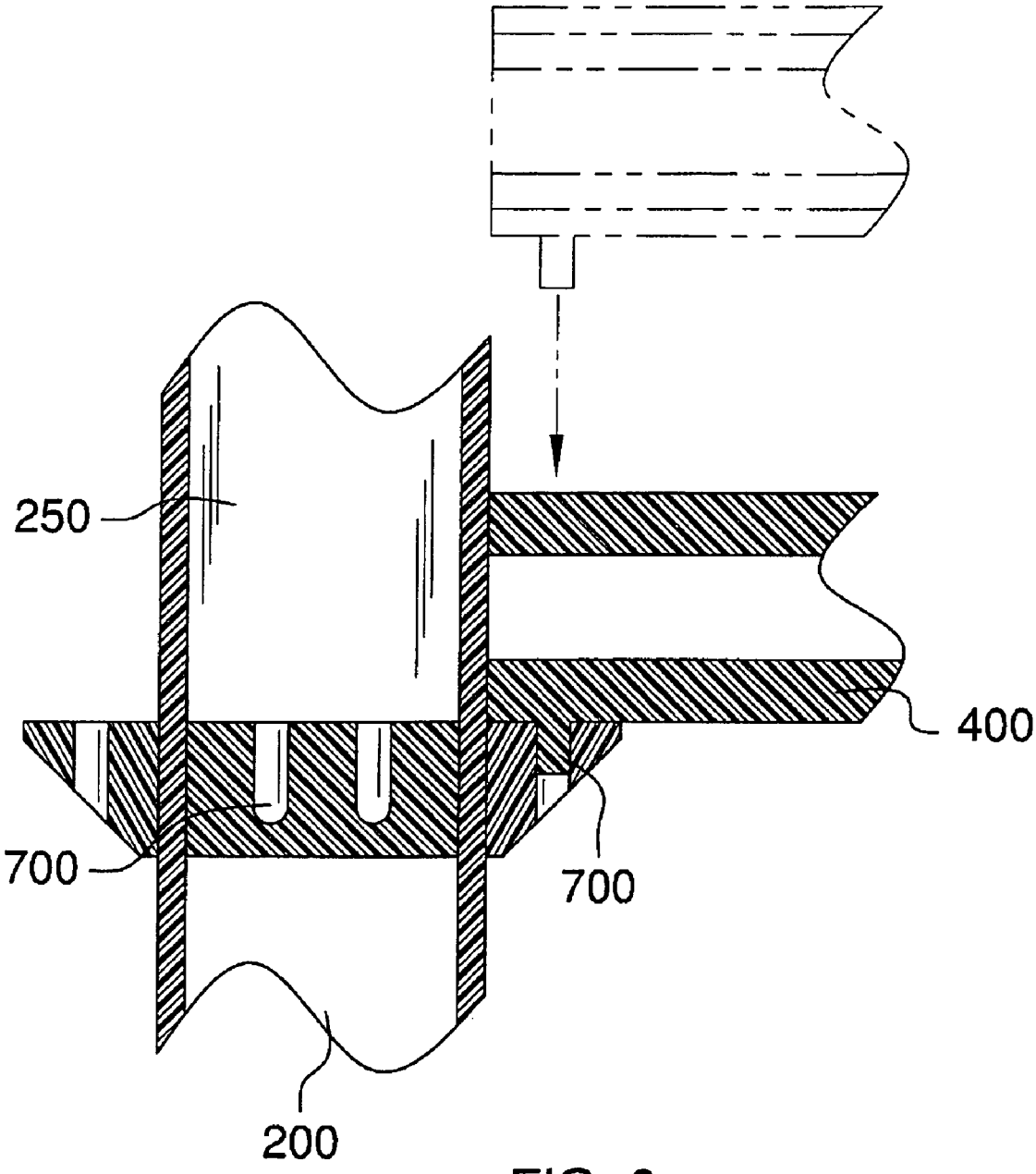
FIG. 6 is a side and internal view of the construction set of the present invention.
Figure 7:
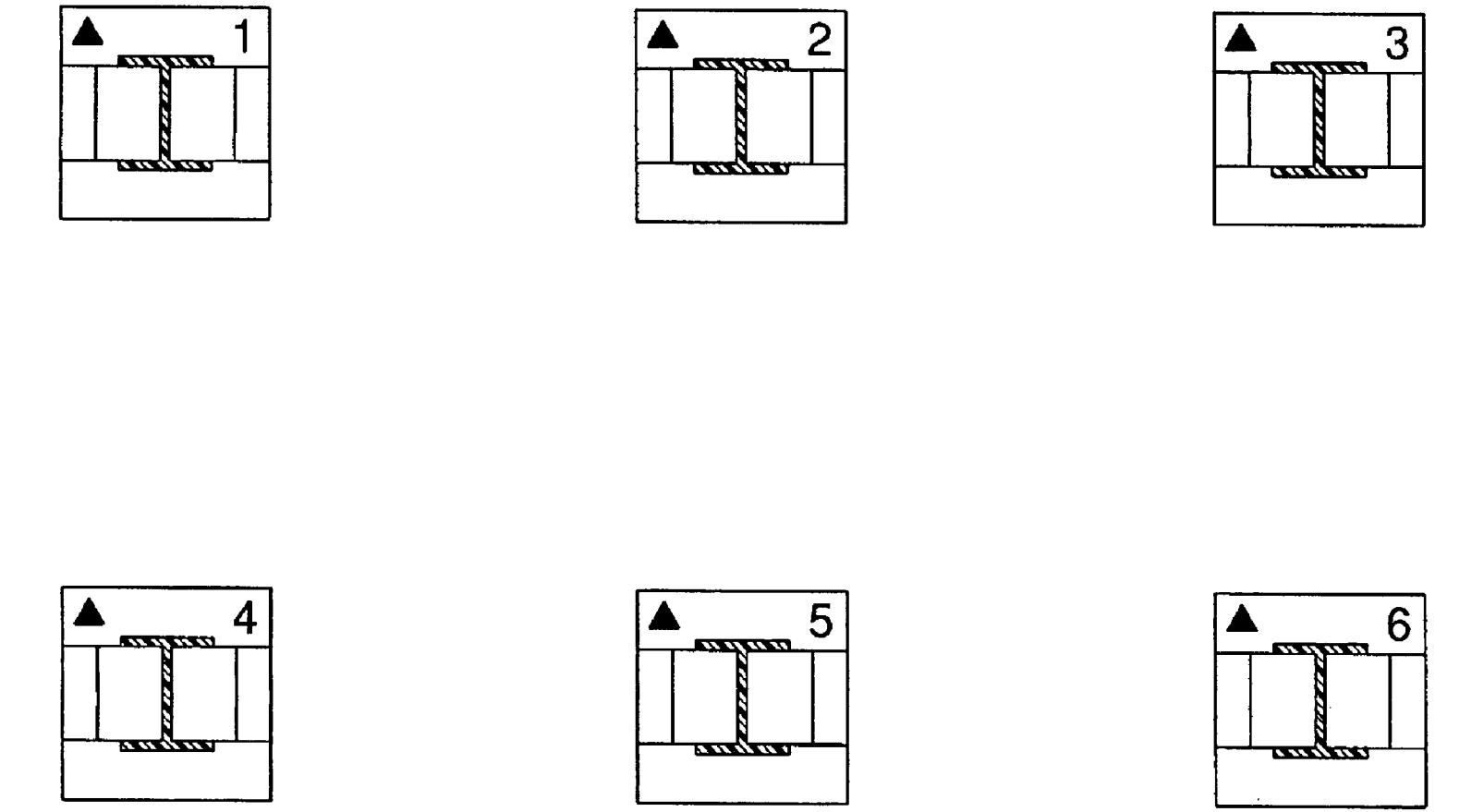
FIG. 7 is a top view of the columns of the construction set of the present invention.
Figure 8:
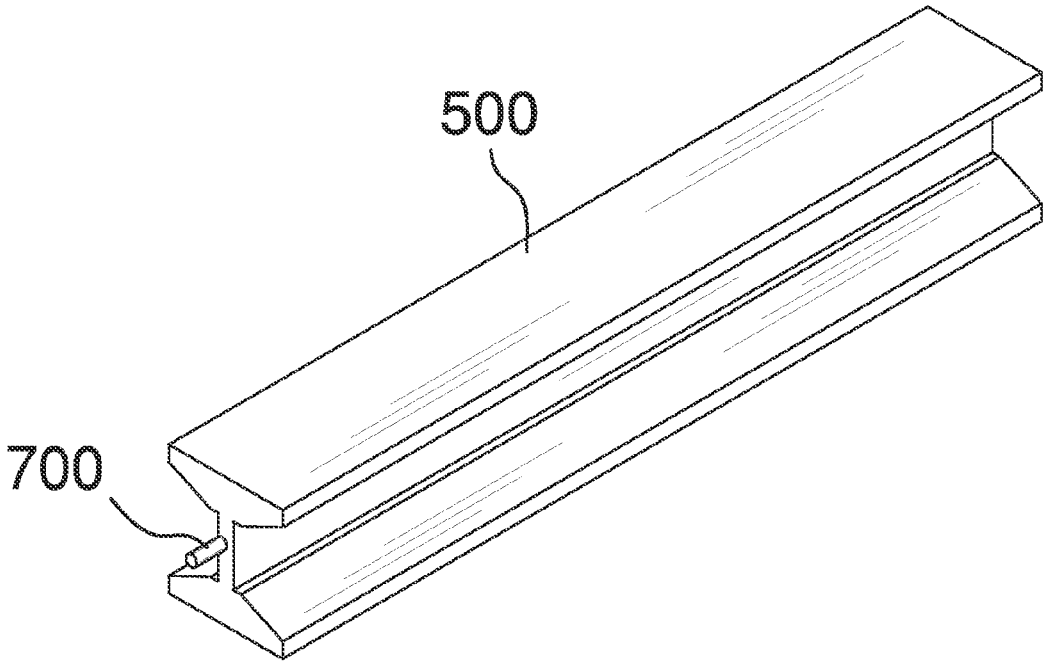
FIG. 8 is a perspective view of a Type B beam of the construction set of the present invention.

402 second end of Type A beam
500 Type B beam
600 seat lug
601 top side of seat lug
610 seat lug hole
700 peg
750 side hole
800 rectangular panel deck piece
801 first side of deck piece
802 second side of deck piece
810 notched deck piece
820 tongue
830 groove Referring now to FIGS. 1-8, the present invention features a construction set for allowing a user to construct a variety of different structures (e.g., buildings). The construction set comprises a plurality of beams (e.g., Type A beams, Type B beams) and a plurality of columns (e.g., base column, intermediate column). The columns are for orienting in a vertical direction and the beams are for orienting in a horizontal direction, wherein the beams may interlock with the columns and/or the columns may interlock with other columns to create a structure of the user's choice. The construction set further comprises a plurality of base plates attached to the base columns for stabilizing the base columns; and a plurality of deck pieces for laying atop the beams to create a floor.

In some embodiments, the beams (and/or columns) are similar in appearance to beams conventionally used in construction of building frames (see FIG. 1, FIG. 3, FIG. 4), e.g., having "H" shaped cross section.

The construction set may be constructed from a variety of materials. For example, in some embodiments, the construction set is constructed from a plastic, a wood, the like, or a combination thereof.

The beams and/or columns and/or seat lugs and/or holes and/or pegs, and or deck pieces and/or splice plate and/or base plate may be constructed in a variety of shapes and/or sizes.

For example, in some embodiments, the pegs are in the shape of a cylinder, a triangle, a cuboid, the like, or a combination thereof. In some embodiments, the hole is in the shape of a circle, a rectangle, a triangle, the like, or a combination thereof.

Columns

The construction set comprises a plurality of base columns and a plurality of intermediate columns, each having a first end, a second end, a first side, a second side, a third side, and a fourth side. In some embodiments, the base columns and the intermediate columns are the vertical members of the construction set that support the beams (e.g., type A beams).

In some embodiments, base columns comprise a base plate disposed on the first end for allowing the base column to stand upright in a vertical orientation.

In some embodiments, one or more seat lugs having a top side and one or more seat lug holes disposed in the top side are removably attached to one or more sides of the base column near the second end of the base column. In some embodiments, seat lugs are disposed not just near the second end of the base column but along one or more sides of the base columns at various intervals.

In some embodiments, one or more seat lugs having a top side and one or more seat lug holes are removably attached to one or more sides of the intermediate columns near the first end and/or the second end of the intermediate column. In some embodiments, seat lugs are disposed not just near the first end and/or the second end of the intermediate columns but along one or more sides of the intermediate columns at various intervals.

In some embodiments, the seat lugs have a top side wherein one or more seat lug holes are disposed in the top side. The holes may be of a variety of shapes and/or sizes (e.g., circular, rectangular, triangular). The seat lugs are for supporting the beams in a horizontal orientation.

In some embodiments, the intermediate columns have one or more splice plates disposed at the first end of the intermediate columns. The splice plates are for connecting the first end of the intermediate columns to the second end of another intermediate column or to the second end of a base column.

Beams

The construction set comprises a plurality of beams (e.g., Type A beams, Type B beams), each having a first end, a second end, a first side, a second side, a third side, and a fourth side. In some embodiments, the beams are the horizontal members of the construction set for attaching to the columns.

In some embodiments, the Type A beams have one or more Type A pegs disposed on one side of the beam near the first end and/or the second end of the beam (e.g., the pegs extend perpendicularly from the beam). The Type A pegs are for inserting into the seat lug holes in the seat lugs of the columns. In some embodiments, the Type A beams have one or more Type A side holes disposed along one or more sides of the Type A beams. The Type A side holes are for accepting Type B pegs on a Type B beam.

In some embodiments, the Type B beams have one or more Type B pegs disposed on the first end and/or the second end of the beam extending outwardly from the first end and/or second end (e.g., the pegs extend in the direction of the beam). The Type B pegs are for inserting into the Type A side holes of the Type A beams.

Decking

In some embodiments, the construction set comprises a plurality of deck pieces for creating a floor, each piece having a first edge, a second edge, a first corner, and a second corner. In some embodiments, the deck pieces are connected (e.g., interlocked) by a connection mechanism. The connection mechanism includes but is not limited to a tongue-and-groove connection (e.g, a snap-in mechanism) (see FIG. 5).

In some embodiments, the deck pieces include rectangular panel pieces and notched pieces, wherein the notched pieces have notches at the first corner and/or the second corner. The notches are for fitting the deck pieces on to the beams and columns such that the deck pieces sit freely on top of beams.

The following the disclosures of the following U.S. Patents are incorporated in their entirety by reference herein: U.S. Pat. No. 5,527,201; U.S. Pat. No. 1,898,297; U.S. Pat. No. 5,239,803; U.S. Pat. No. 5,199,919; U.S. Pat. No. 3,657,838; U.S. Pat. No. 4,084,344.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A construction set for allowing a user to construct a variety of different structures, said construction set comprising:

(a) a plurality of base columns, each base column having a first end, a second end, a first side, a second side, a third side, and a fourth side; wherein the base columns are for orienting in a vertical direction; wherein each base column has a base plate disposed on the first end for allowing the base column to stand upright in a vertical direction;

(b) a plurality of intermediate columns, each intermediate column having a first end, a second end, a first side, a second side, a third side, and a fourth side; wherein a splice plate is disposed at the first end of the intermediate columns, said splice plate for connecting the columns; wherein the intermediate columns are for orienting in a vertical direction;

(c) a plurality of Type A beams, each Type A beam having a first end, a second end, a first side, a second side, a third side, and a fourth side; wherein the type A beams are for orienting in a horizontal direction; wherein one or more pegs are disposed in at least one of the sides of the Type A beams, wherein one or more holes are disposed in at least one of the sides of the Type A beams;

(d) a plurality of Type B beams, each Type B beam having a first end, a second end, a first side, a second side, a third side, and a fourth side; wherein the type B beams are for orienting in a horizontal direction, wherein one or more Type B pegs extend outward from the ends of the type B beam and extend in the same direction as the beam; wherein the Type B pegs are for inserting into the Type A side holes disposed in the Type A beams;

(e) a plurality of seat lugs, each seat lug having a top surface and one or more seat lug holes disposed in the top surface; wherein the seat lugs are removably attached to any one of the sides of the base columns; wherein the seat lug holes are for receiving a Type A peg disposed on a Type A beam; wherein the seat lugs are for supporting Type A beams in a horizontal orientation; and (f) a plurality of deck pieces for placing atop the Type A beams and Type B beams to create a floor, each deck piece having a first edge, a second edge, a first corner, and a second corner; wherein the deck pieces can be connected together via a connection mechanism;

wherein the Type A side holes are for accepting a peg on a Type B beam; wherein the intermediate columns are for supporting the type A beams and the type B beams; wherein the Type A beams can attach to base columns or intermediate columns; wherein the Type B beams can attach to Type A beams; wherein intermediate columns can attach to base columns or different intermediate columns.

2. The construction set of claim 1, wherein a deck piece is a rectangular panel piece.

3. The construction set of claim 1, wherein a deck piece is a notched piece, wherein the notched piece has a notch on the first corner and/or the second corner, wherein the notches are for fitting the deck piece on top of Type A beams or Type B beams and in between base columns or intermediate columns.

* * * * *